United States Patent [19]

Washington

[11] Patent Number: 4,682,971

[45] Date of Patent: Jul. 28, 1987

[54] STICK AND HOOP TOY

[76] Inventor: Leo Washington, 2612 Grenada Cir. West, St. Petersburg, Fla. 33712

[21] Appl. No.: 866,930

[22] Filed: May 27, 1986

[51] Int. Cl.[4] ..... A63H 33/02

[52] U.S. Cl. ..... 446/450

[58] Field of Search ..... 446/450, 451, 453, 411

[56] References Cited

U.S. PATENT DOCUMENTS

| | | | |
|---|---|---|---|
| 1,953,426 | 4/1934 | Mills | 446/453 |
| 3,494,069 | 2/1970 | Klimko | 446/450 |
| 3,758,984 | 9/1973 | Spransy et al. | 446/453 |
| 3,827,180 | 8/1974 | Phillips, Jr. | 446/450 |

*Primary Examiner*—Mickey Yu

*Attorney, Agent, or Firm*—Ronald E. Smith

[57] ABSTRACT

A toy having an elongate handle that terminates in a yoke member that loosely but non-releasably engages one or two hoop members. The hoop members are free to roll on a support surface when the user of the invention runs or walks quickly while holding onto the handle and while maintaining the hoop or hoops substantially in a vertical plane through skilled manipulation of the handle. The yoke member retains the hoop or hoops within a space defined by it at the end of the handle and the yoke member is fixedly secured to the end of the handle; accordingly, the hoop or hoops cannot escape the yoke member and thus cannot escape the control of the user of the invention.

1 Claim, 4 Drawing Figures

STICK AND HOOP TOY

BACKGROUND OF THE INVENTION

1. Field of the Invention

This invention relates generally to motorless toys, and more specifically relates to a hoop toy where one or more hoops are positioned at the end of a handle so that the hoops can be made to roll across a support surface through skilled manipulation of the handle.

2. Description of the Prior Art

Around the turn of the century, a popular game played by children included a hoop and a stick.

The hoop would be made to roll in a vertical plane by a child who would run along with the rolling hoop and hit it with a stick from time to time to keep it rolling and to otherwise direct its movement.

Over the years, inventors have developed new versions of the old hoop and stick game; a modern version of the game actually provides lights on the hoop, a battery means on the stick, and appropriate conductors on the hoop and stick so that the hoop lights up every time it is contacted by the stick.

All of the known improvements on the old game device suffer from a common shortcoming, however: they are not as safe as they should be.

In the early days of the twentieth century, automobile traffic was light and children dashing out into a street chasing a hoop were unlikely to be struck by vehicles.

However, in modern times, traffic has increased to the point where it is unsafe in most towns for children to even own a hoop toy. As a result, the game device has fallen into disuse and a piece of Americana has been lost.

A safe version of the game is needed. Moreover, since modern children are harder to please when it comes to amusement devices than were their ancestors, in view of the plethora of devices available today, there is a need for an improved, more exciting and more difficult version of the old game.

SUMMARY OF THE INVENTION

The present invention provides a hoop toy that is safer than the hoop toys of the past and that is more interesting to use as well.

It includes an elongate handle and one or more hoops, depending upon the complexity of the game to be played; advanced players will prefer the two hoop version of the novel device.

Two breakthroughs are achieved by the inventive device: (1) it is made safer and (2) its use is made more challenging.

The trouble with the old hoop toys, as mentioned hereinabove, is that the hoops could escape the control of the child playing with them and roll into a traffic artery; the child, caught up in the fun of the chase, could forget safety lessons taught at school and dash out into the street after the runaway hoop.

This serious problem has gone unsolved for nearly a century, if not longer.

The present invention yokes the hoop or hoops to the handle and thereby prevents the escape of the hoop or hoops from the control of the child.

The handle terminates in a "T"-shaped joint in the form of a "T"-shaped tubular member. The vertical portion of the "T" joint slidingly but fixedly receives the distal free end of the handle (the proximal end thereof being gripped by the child), and the rectilinear portion of a flexible yoke member having the general configuration of a "D" is engaged by the horizontal portion of the "T" joint.

A hoop or hoop is positioned within the confines of the "D"-shaped yoke member; since the yoke member is fixedly secured to the handle, the hoop or hoops are also confined to the immediate proximity of the distal end of the handle as well.

The yoke member is in the form of a stiff but deformable and resilient wire member or other suitable material and it is bent into a "D" shape as aforesaid; accordingly, it may be transiently deformed so that a hoop or hoops may be inserted into or removed from the space surrounded and thus defined by said yoke member. Specifically, its opposite ends can be transiently spaced apart to provide an opening through which the hoops may pass, and then said ends can again by placed in close juxtaposition with one another to confine the hoop or hoops.

The relative sizes of the hoops and the yoke member is such that the hoops are free to roll while confined by the yoke member, and the resiliency of the yoke member is sufficient to allow the hoops to be removed therefrom when desired but is insufficient to allow them to escape from the confines thereof inadvertently.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawing.

DETAILED DESCRIPTION OF THE PREFERRED EMBODIMENT

Figure 1:
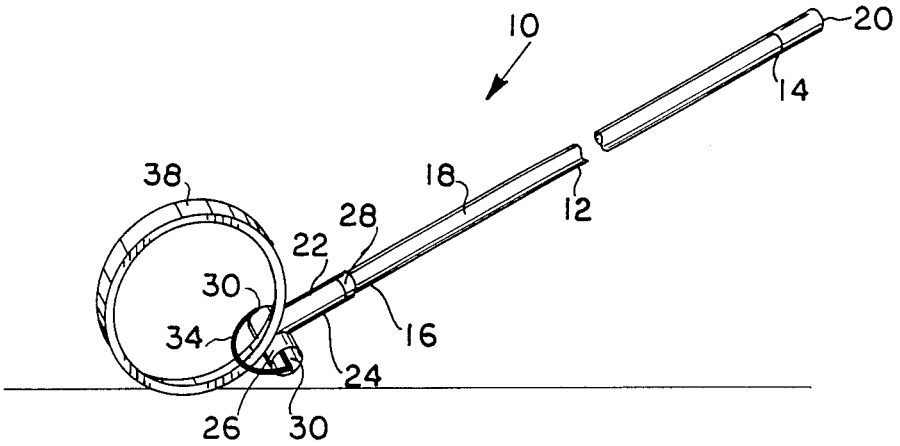
FIG. 1 is a perspective view of the novel device, showing one hoop positioned within the yoke means.

Referring now to the drawings, it will there be seen that the toy as a whole is indicated by the reference numeral 10.

Toy 10 includes elongate, rigid handle 12 having a proximal end 14, a distal end 16, and a medial portion 18 that may be of any preselected length.

Cap 20 caps the proximal end 14 for aesthetic and safety reasons.

Tubular joint 22 has a vertical portion 24 and a horizontal portion 26; distal end 16 of handle 12 is press fit into portion 24 to non-releasably connect handle 12 and joint 22.

A reflective strip 28 may be applied to vertical portion 24 as a safety feature.

The rectilinear portion 30 of "D"-shaped yoke member 32 is slideably and loosely received within the elongate cavity defined by the horizontal portion 26 of joint 22. Accordingly, the arcuate portion 34 of yoke member 32 is positioned externally of joint 22 as shown.

Figure 4:
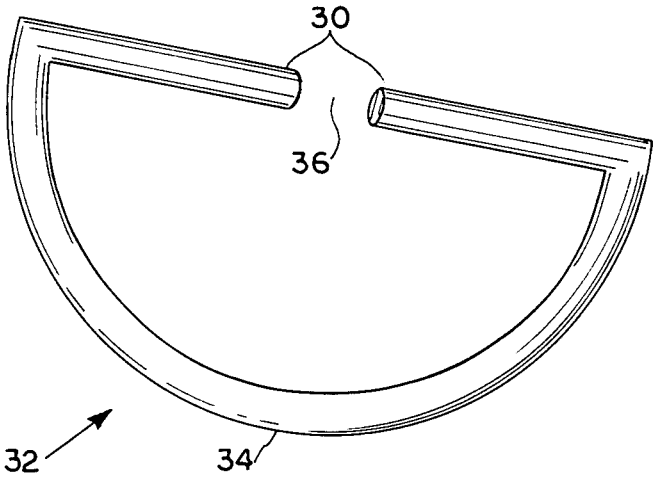
FIG. 4 is a perspective view of the resilient "D"-shaped yoke member.

Preferably, yoke member 32 is provided in the form of a straight, heavy guage wire or other suitable material and is bent into its "D" shape; ideally, the opposite ends of the "D" would meet midlength of the rectilinear portion 30 of said yoke 32 as denoted by the reference numeral 36 in FIG. 4.

Thus, when it is desired to disengage yoke 32 from joint 22, the opposite ends of the resilient material are separated to allow the desired disengagement. A hoop or hoops may then be inserted into or removed from the confines of the yoke 32. Thus, the toy can be used with one or more hoops, and different sizes of hoops can be used as well.

When only one hoop 38 is confined by yoke member 32 as depicted in FIG. 1, said hoop can be made to roll atop a support surface with relative ease.

Figure 2:
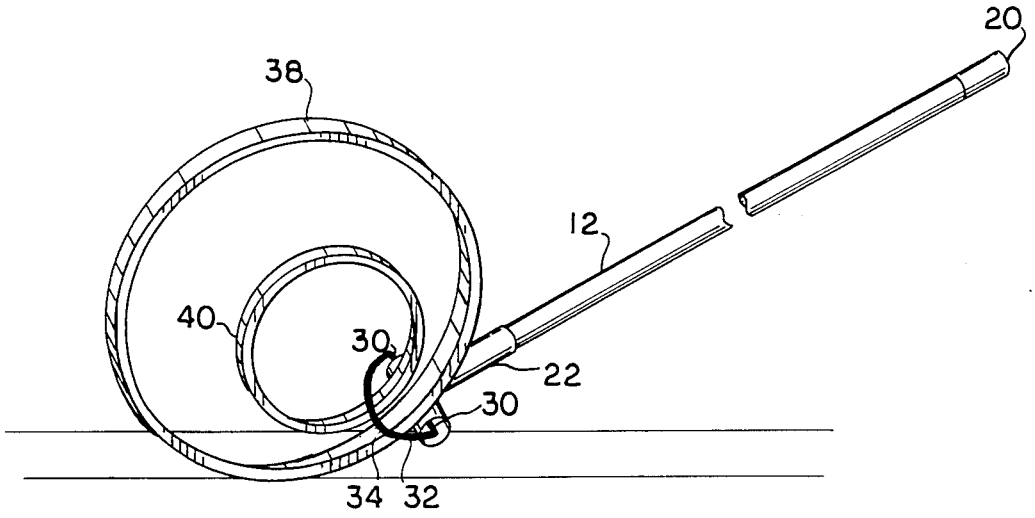
FIG. 2 is a perspective view of the novel device, showing a pair of hoops retained by the yoke member.
Figure 3:
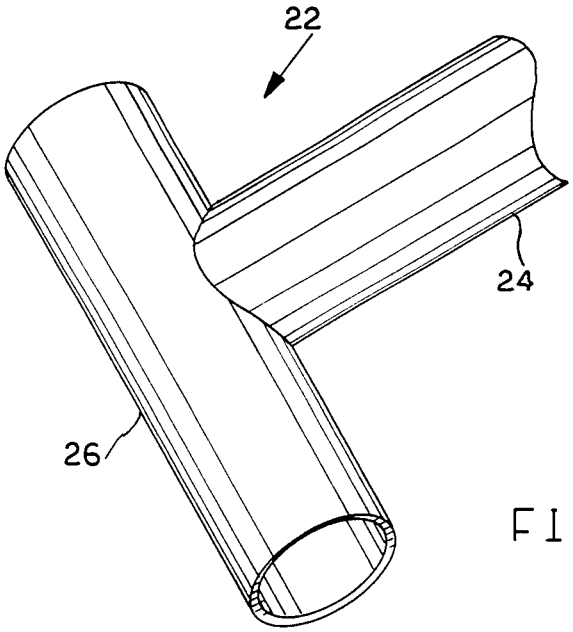
FIG. 3 is a perspective view of the "T"-shaped joint which forms a part of the invention.

However, when two hoops of differing diameters are employed, as depicted in FIG. 2, the level of skill required to maintain both hoops rolling in a vertical plane increases.

Skilled players can position the small hoop 38 on a first side of the larger hoop 40, and by flicking their wrists in a skilled manner they can cause the smaller hoop 38 to pass through the larger hoop 40 and continue rolling on the opposite side thereof.

In either embodiment, yoke member 32 ensures that no hoop will escape therefrom; accordingly, the hoop or hoops will always be positioned at the distal end of handle 12 and thus they cannot get away from the child.

The handle 12 can be lengthened for taller children, energetic adults, or physical education teachers desiring to demonstrate proper use of the toy.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A hoop toy of the type including a single handle, plural hoops, and means for preventing the hoops from rolling away from the handle, comprising:

a single, elongate handle member;

a single, "D"-shaped hoop-retaining yoke member secured to a distal end of said handle member;

plural hoop members of differing diameters being positioned within the confines of said yoke member;

said hoop members being independently formed with respect to each other and thus being substantially nonengageable with each other;

said yoke member having a straight portion positioned rearwardly of said plural hoop members so that said plural hoop members at any given time will have portions thereof slideably engaged by said straight portion simultaneously when said toy is in operation;

said yoke member having a curved portion positioned forwardly of said portions of said plural hoop members to retain said hoop members within the confines of said yoke member;

said plural hoop members being positioned in lateral relation to one another when the toy is in operation;

and a specific later relationship of the plural hoops with respect to one another being changeable by the operator of the toy by manipulation of said handle member when said hoop members are rolling in a uniform direction.

* * * * *